United States Patent [19]

Sasaki

[11] Patent Number: 5,020,410

[45] Date of Patent: Jun. 4, 1991

[54] SOUND GENERATION PACKAGE AND AN ELECTRONIC MUSICAL INSTRUMENT CONNECTABLE THERETO

[75] Inventor: Hiroyuki Sasaki, Fussa, Japan

[73] Assignee: Casio Computer Co., Ltd., Tokyo, Japan

[21] Appl. No.: 424,893

[22] Filed: Oct. 20, 1989

[30] Foreign Application Priority Data

Nov. 24, 1988 [JP] Japan ..... 63-294592

[51] Int. Cl.[5] ..... G10H 7/00; G10H 1/00

[52] U.S. Cl. ..... 84/602; 84/622; 84/645

[58] Field of Search ..... 84/602, 622, 645

[56] References Cited

U.S. PATENT DOCUMENTS

| | | | |
|---|---|---|---|
| 3,809,786 | 5/1974 | Deutsch | 84/608 |
| 4,018,121 | 4/1977 | Chowning | 84/696 |
| 4,416,177 | 11/1983 | Loeb | 84/620 |
| 4,617,851 | 10/1986 | Sato | 84/622 |
| 4,635,519 | 1/1987 | Sakurai | 84/715 |
| 4,658,691 | 4/1987 | Ishibashi | 84/605 |
| 4,702,141 | 10/1987 | Bonanno | 84/645 X |
| 4,748,887 | 6/1988 | Marshall | 84/645 X |
| 4,805,509 | 2/1989 | Matsuda | 84/604 |

*Primary Examiner*—William M. Shoop, Jr.
*Assistant Examiner*—B. Sircus
*Attorney, Agent, or Firm*—Frishauf, Holtz, Goodman & Woodward

[57] ABSTRACT

A sound source package having a sound generation circuit and a memory storing a timbre editing program used for editing the timbre parameters can be connected to an electronic musical instrument. The electronic musical instrument reads out the timbre editing program from the sound source package. A user can edit the timbre of the musical sound to be generated from the sound source package by operating operation switches of the electronic musical instrument in accordance with the timbre editing program supplied from the sound source package.

15 Claims, 6 Drawing Sheets

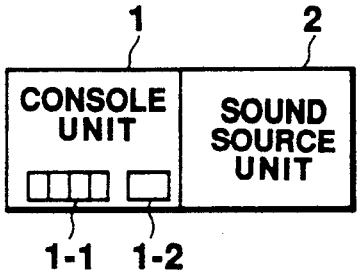
FIG. 1
*(PRIOR ART)*
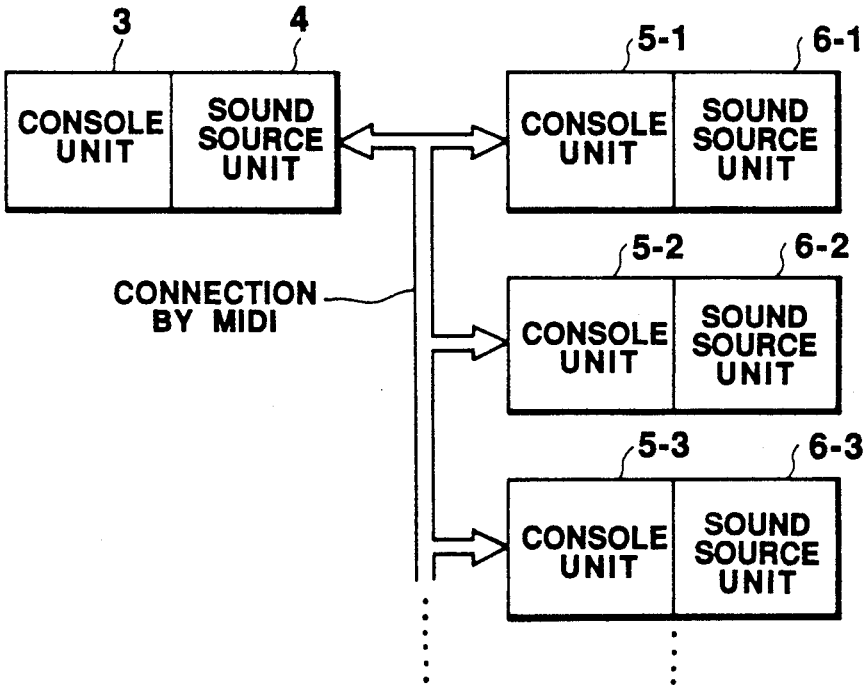
FIG. 2 *(PRIOR ART)*

SOUND GENERATION PACKAGE AND AN ELECTRONIC MUSICAL INSTRUMENT CONNECTABLE THERETO

BACKGROUND OF THE INVENTION

1. Field of the Invention

The present invention relates to a sound generation device or package and an electronic musical instrument connectable to the sound generation device from its outside.

2. Description of the Related Art

An electronic musical instrument called as a musical synthesizer or a sound module which has an editing function of timbre parameters of a musical sound to be produced is conventionally known.

FIG. 1 shows a musical instrument of this kind. The instrument is constructed as one unit by a console unit 1 having a plurality of operation keys 1-1 and display unit 1-2 which are provided for a user to edit timbre parameters of a musical sound, and a sound source unit 2 for producing a sound signal having characteristics determined by the edited timbre parameters. In such an integrated musical instrument, the console unit 1 and the sound source unit 2 are connected closely and indivisible to allow the user to edit timble parameters of a sound to be produced from sound source unit 2 by operating the keys 1-1 while seeing the display unit 1-2.

Recently, another type of the electronic musical instrument system was developed. FIG. 2 shows a system of this type which includes an electronic musical instrument used for musical performing operation i.e., a key input operation, other electronic musical instruments used for sound generation, and communication means based on MIDI (Musical Instrument Digital Interface) standard for selectively connecting the musical instrument for the musical performing operation with one or more external electronic musical instruments for the sound generation. The electronic musical instrument for musical performing is often called as a MIDI controller or music controller.

In such musical instrument system, however, not the console unit 3 of the MIDI controller but the console units 5-1 to 5-3 of external instruments are used for editing the sound parameters of musical tones to be produced from the sound source units 6-1 to 6-3 in the external instruments.

The console unit 3 of the musical instrument used for the musical performing operation is effective only to its own sound source unit with respect to editing timbre parameters of a sound.

In order to allow a user to execute timbre editing operations for various types or kinds of sound source units by a common console unit 3, a plurality of unique editing programs are required for the respective sound source units. FIG. 3 shows such a system. This system needs an expanded memory 7 for storing a desired editing program of sound parameters compatible for a selected one of the sound source units 6-1 to 6-3, and an expensive floppy disk drive 8 for loading the editing program to the expanded memory 7 from a disk containing the program.

SUMMARY OF THE INVENTION

The present invention has been made to solve the problem as discussed above, and has as its object to provide an electronic musical instrument which is connectable with various types or kinds of sound generation device. More specifically, the invention provides a musical instrument with a console unit capable of editing timbre parameters for any or substantially any type or kind of sound source device connected to the musical instrument without employing the expensive floppy disk drive and the like.

In accordance with one aspect of the present invention, there is provided a sound source device or package connectable to an electronic musical instrument from its outside, which includes a sound source means, and a timbre editing program storing means for storing a timbre editing program which is used in the electronic musical instrument so as to edit timbre parameters defining the timbre of a sound to be generated from the sound source means.

In accordance with another aspect of the present invention, there is provided an electronic musical instrument connectable to a sound source device or package, the instrument including a timbre parameter editing means for editing timbre parameters defining the timbre of a sound to be produced from a sound source means in the sound source device, in accordance with a timbre editing program read out from a timbre editing program storing means in the sound source device.

BRIEF DESCRIPTION OF THE DRAWINGS

The other objects and characteristics of the present invention are to be understood by one skilled in the art according to the description of preferred embodiments of the present invention with reference to the accompanying drawings, in which:

FIG. 1 is a diagram showing an electronic musical instrument of the prior art which is constructed as one unit by a sound source unit and a console unit used for editing timbre parameters of a sound obtained from the sound source unit;

FIG. 2 is a diagram showing an arrangement of the prior art in which an electronic musical instrument used for musical performance operation is connected to electronic musical instruments used for sound generation via MIDI;

DETAILED DESCRIPTION OF THE PREFERRED EMBODIMENTS

An electronic musical instrument and a sound generation device of the present invention will be described hereinafter with reference to the accompanying drawings.

Figure 3:
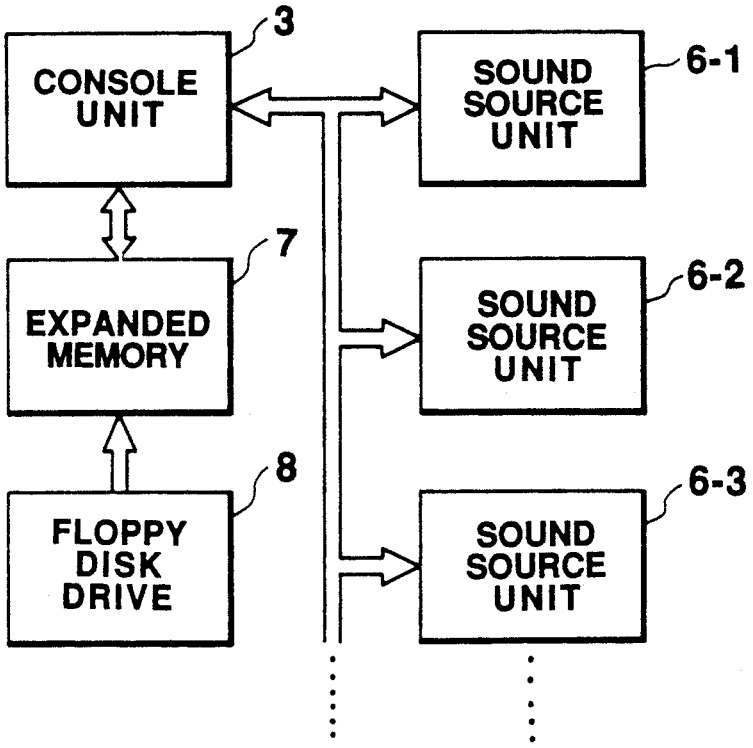
FIG. 3 (PRIOR ART)
FIG. 3 is a diagram showing an arrangement of the prior art in which an expanded memory and a floppy disk drive are used for editing timbre parameters of sounds to be produced from various types and kinds of sound source units by a single console unit.
Figure 4:
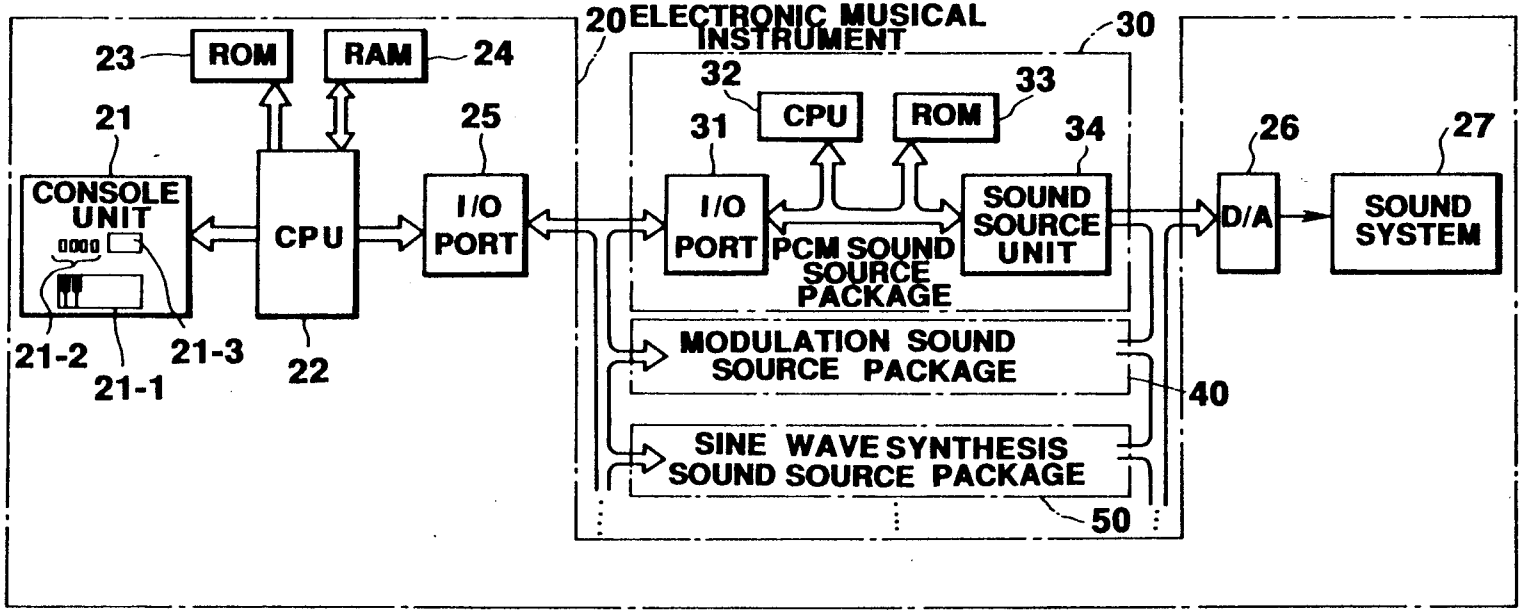
FIG. 4 is a diagram showing an overall circuit arrangement of a preferred embodiment of the invention which includes an electronic musical instrument and a sound source package connectable to the instrument from its outside.

FIG. 4 shows an overall circuit diagram of an electronic musical instrument and sound source packages each connectable to the instrument in accordance with the first embodiment of the invention. The instrument 20 has a console unit 21 including a keyboard 21-1 for musical performance operation, various kinds of operation keys 21-2 used for timbre editing operation, and a display unit 21-3 and the like. The instrument 20 further includes a CPU 22. The CPU 22 controls the whole operation of the musical instrument in accordance with a microprogram stored in ROM 23. RAM 24 is arranged to store a timbre editing program read out from a sound source package as described later. Note that, RAM 24 does not store anything when a power of the instrument 20 is turned on.

An I/O port 25 coupled to CPU 22 in the musical instrument 20 is operated to allow data communication between the musical instrument 20 and a sound source package connected thereto.

PCM sound source package 30 includes an I/O port 31, CPU 32, ROM 33 and a sound source unit 34 coupled to one another as shown in FIG. 4. The sound source unit 34 is constructed as a PCM (pulse code modulation) sound source circuit as disclosed in U.S. Pat. No. 4,805,509 to Matsuda issued on Feb. 21, 1989.

Modulation sound source package 40 and sine wave synthesis sound source package 50 are constructed similarly to the PCM sound source package 30. The sound source unit 34 in the modulation sound source package 40 can employ a sound generation circuit of a non-linear modulation type, for example, the circuit as disclosed in U.S. Pat. No. 4,018,121 to Chowning issued on Apr. 19, 1979 to realize a FM (frequency modulation) sound source package or the circuit as disclosed in U.S. Pat. No. 4,658,691 to Ishibashi issued on Apr. 21, 1987 to realize a PD (phase distortion) sound source package. The sound source unit 34 in the sine wave synthesis sound source package 50 is constructed as a sine wave synthesis sound source circuit as disclosed in U.S. Pat. No. 3,809,786 to Deutsch issued on May 7, 1974.

The I/O port 31 of the package is connected to the I/O port 25 in the instrument 20 for transmitting data between the instrument 20 and the sound source package 30, 40, 50 or any other sound source package connectable to the instrument. ROM 33 in the PCM sound source package 30 stores a timbre editing program for executing a timbre editing operation for the sound source unit 34, and a microprogram for controlling a whole operation of the PCM sound source package 30.

The sound source unit 34 generates a sound signal and supplies the signal to a D/A converter 26 in the electronic musical instrument 20. The sound signal is converted to an analog sound signal by the D/A converter 26 and outputted as an audio signal via a sound system 27.

Figure 5A:
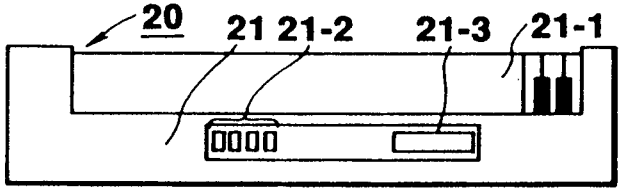
FIG. 5A is a plan view of the instrument in FIG. 4.
Figure 5B:
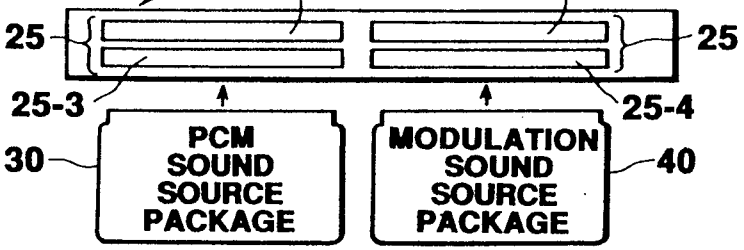
FIG. 5B is a rear view of the instrument in FIG. 4 with a diagrammatic outside plan view of sound source packages.

FIG. 5A shows a plan view of the instrument 20 and FIG. 5B shows a rear view of the instrument with an outside plan view of sound source packages 30 and 40. In FIGS. 4, 5A and 5B, the same reference numerals denote the parts having the same functions.

In FIG. 5B, the PCM sound source package 30 and the modulation sound source package 40 may be inserted into slots, for example, 25-1 and 25-2 of the musical instrument 20 correspondingly and connected to the musical instrument 20 electronically. In this embodiment, the instrument 20 has four slots 25-1 to 25-4. However, the number of the slots is not limited to four as this embodiment.

The operation of the embodiment will be explained below referring to the drawings.

At first, a musical performance operation of the instrument 20 will be described. CPU 22 obtains a performance information derived from the key operation of the keyboard 21-1, and transmits the performance information via I/O port 25 to a connected sound source package which may be either the PCM sound source package 30 or modulation sound source package 40 inserted in the slot 25-1 or 25-2 individually. The sound source package that receives the performance information may be selected by the operation of the operation keys 21-2. When received the performance information, the selected sound source package, e.g., 30 causes CPU 32 to control the sound source unit 34 according to the received performance information to generate corresponding musical sound signals (see Sb-5 in FIG. 6B).

Figures 6A, 6B:
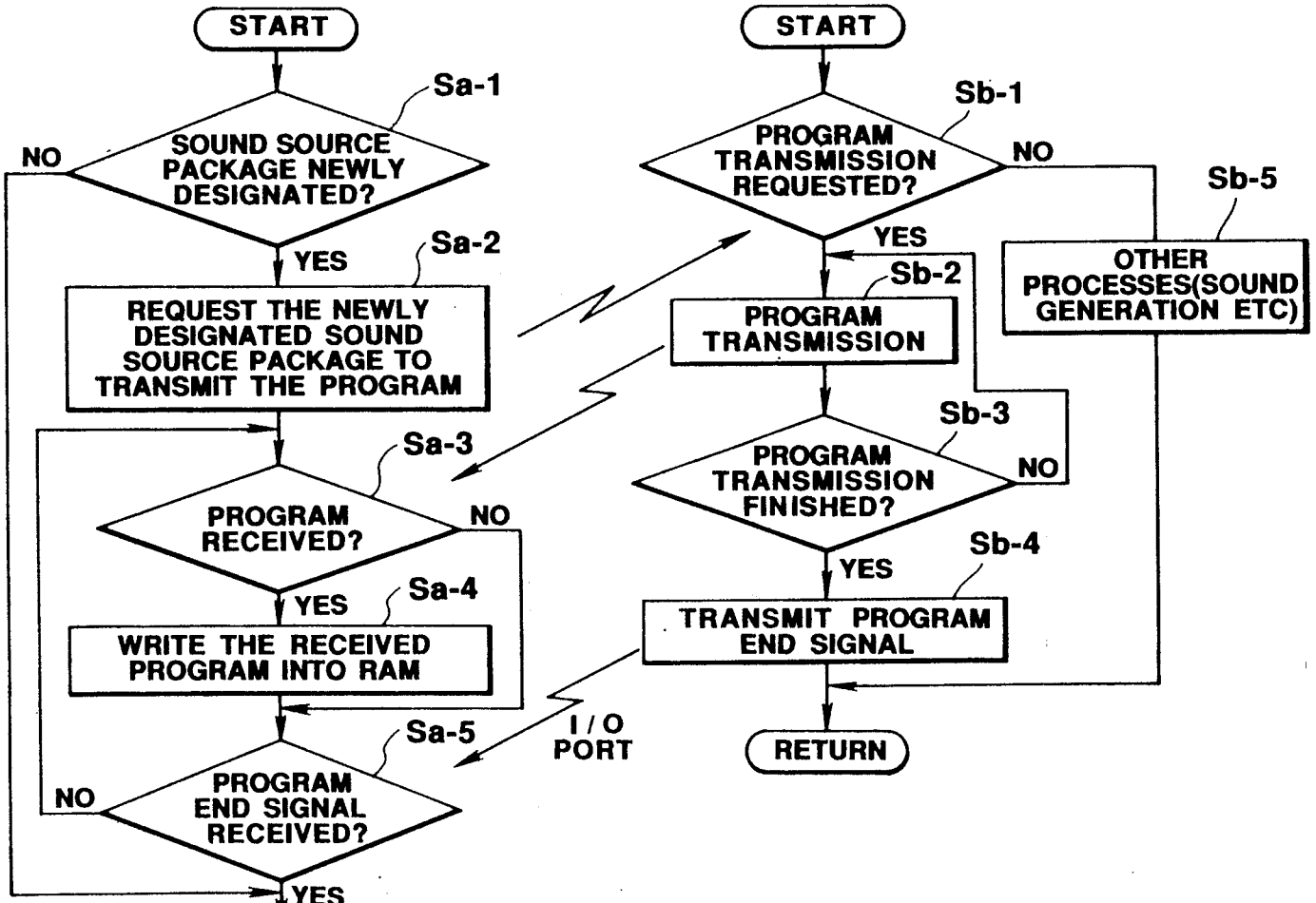
FIGS. 6A and 6B are flow charts representing a transmitting operation of timbre editing program from a sound source package to the electronic musical instrument.

Transferring operation of a timbre editing program between the electronic musical instrument 20 and sound source packages will be explained below with reference to FIGS. 6A and 6B. Note that FIG. 6A shows a flow chart representing an operation of CPU 22 in the electronic musical instrument 20 while FIG. 6B shows a flow chart representing an operation of CPU 32 in the sound source package.

CPU 22 in the instrument 20 scans the operation keys 21-2 at predetermined time intervals, and judges in step Sa-1 as to whether a sound source package is newly designated by the operation keys 21-2 or not. If this is the case, CPU 22 requests in step Sa-2 the newly designated sound source package to transmit the timbre editing program stored in its own ROM 33.

This request is detected by the sound source package CPU 32 in step Sb-1. Then, CPU 32 reads out the timbre editing program from ROM 33 and transmits it to the electronic musical instrument 20 via I/O port 31 (Sb-2).

In the electronic musical instrument 20, whether the timbre editing program has been received or not is checked in step Sa-3. The received timbre editing program is written into RAM 24 in step Sa-4.

In the sound source package, whether the transmission of the timbre editing program is entirely finished or not is checked in step Sb-3. Until then the sound source package continues sending the timbre editing program to the electronic musical instrument 20 (Sb-2). Having finished the sending of the entire timbre editing program, the sound source package CPU 32 supplies a program end signal to the electronic musical instrument 20 in step Sb-4.

In the electronic musical instrument 20, whether the program end signal has been received or not is judged in step Sa-5. Until the program end signal is received, the transmitted timbre editing program is continued to be written into RAM 24 in step Sa-4.

When the instrument CPU 22 receives the program end signal from the sound source package (Sa-5), it returns to the main routine not shown. In this way, the timbre editing program for the sound source unit 34 in the newly designated sound source package is transferred to the electronic musical instrument 20. Then, by operating suitable operation keys 21-2 of the console unit 21 arranged in the electronic musical instrument 20 a timbre editing operation for the sound source unit 34 in the sound source package is executed under the control of CPU 22 in accordance with the timbre editing program stored in RAM 24 to provide edited timbre parameters. The instrument CPU 22 transfers the edited timbre parameters to the sound source package via I/0 ports 25 and 31 for storing into RAM (not shown) in the package CPU 32. Therefore, sound source unit 34 can produce a sound signal having the timbre defined by the edited timbre parameters under the control of CPU 32.

In the above-mentioned first embodiment, a timbre editing program is transferred from a selectively designated sound source package among a plurality of sound source package fit in slots 25-1 to 25-4 of the musical instrument 20. However, the number of the slots could be reduced to one, and the electronic musical instrument could obtain the timbre editing program automatically in response to the insertion of a sound source package into the only one slot.

Figure 7A:
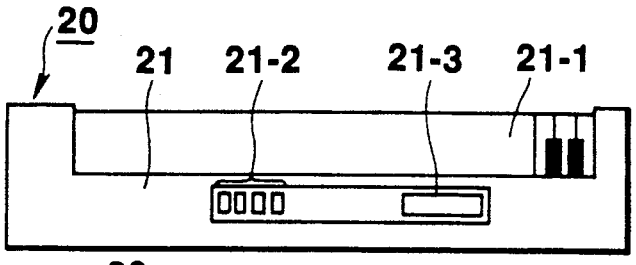
FIG. 7A is a plan view of an instrument of another preferred embodiment of the present invention.
Figure 7B:
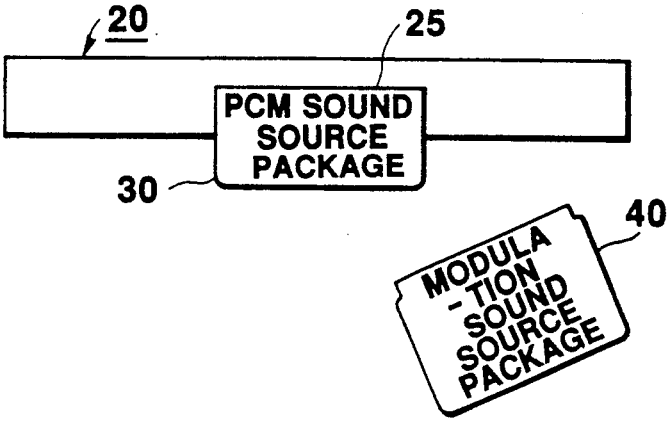
FIG. 7B is a rear view of the instrument shown in FIG. 7A with a diagrammatic outside plan view of sound source packages.

FIGS. 7A and 7B show another embodiment of the invention. As shown in FIG. 7B, only one slot 25 is provided, and PCM sound source package 30 is inserted into this slot 25 now. When a user desires to replace the PCM sound source package 30 with a different sound package, for example modulation sound source package 40, he can do the exchange by pulling out the inserted PCM sound source package 30 from the slot 25 of the instrument 20, and inserting the modulation sound source package 40 into the slot 25.

Figures 8A, 8B:
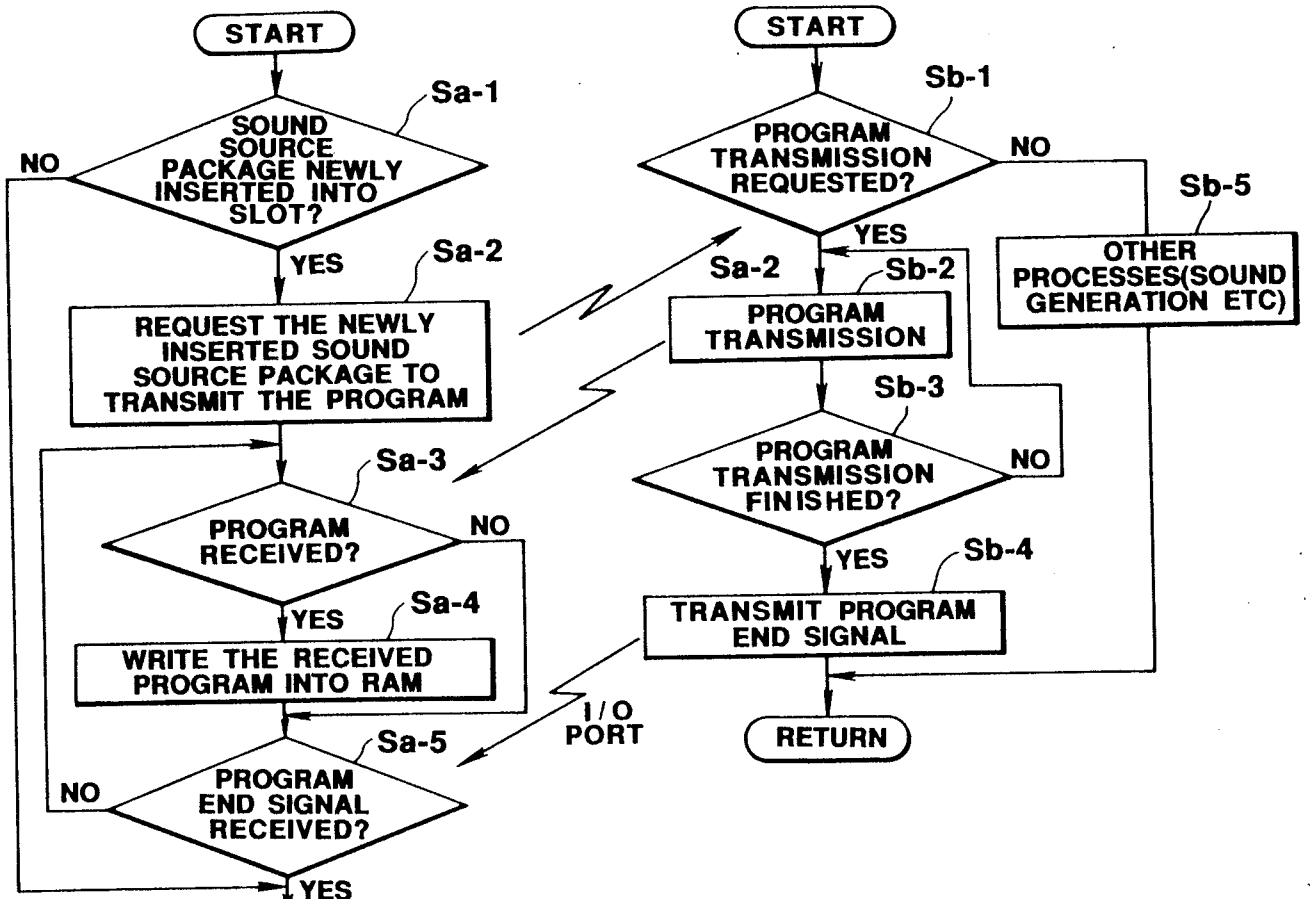
FIGS. 8A and 8B are flow charts representing a transmitting operation of timbre editing program from a sound source package to the instrument according to the other embodiment.

The electronic musical instrument 20 obtains the timbre editing program automatically from the sound source package upon its insertion into the slot 25. FIGS. 8A and 8B show the associated operation of the instrument 20 and a sound source package. The processing routine shown in FIGS. 8A and 8B is the same as that of the first embodiment shown in FIGS. 6A and 6B except steps Sa-1 and Sa-2.

In step Sa-1 of FIG. 8A, the electronic musical instrument 20 checks to see whether a sound source package is newly inserted into the slot 25 or not. If this is the case, the instrument 20 requests the inserted sound source package to transmit the timbre editing program as shown in step Sa-2. After the processing of step Sa-2, the same routine is executed in the instrument 20 and the sound source package as explained in the first embodiment.

Figure 9A:
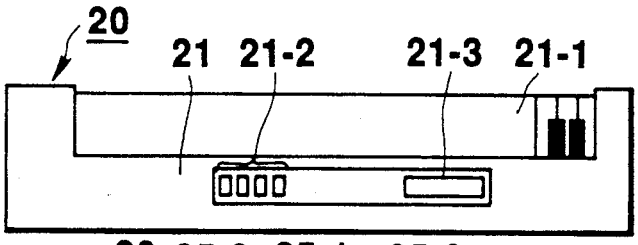
FIG. 9A is a plan view of an instrument of still another embodiment of the present invention.
Figure 9B:
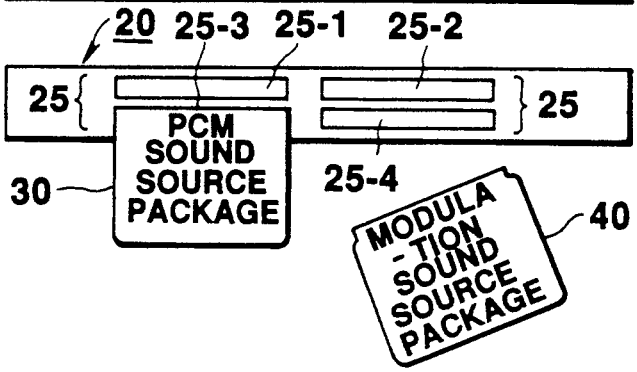
FIG. 9B is a rear view of the instrument shown in FIG. 9A with a diagrammatic outside plan view of sound source packages.

A still another embodiment is shown in FIGS. 9A and 9B. In this embodiment, four slots 25-1 to 25-4 are provided in the instrument 20, and any sound source package inserted into any one of slots 25-1 to 25-4 finally is detected by the instrument 20 so that the timbre editing program stored in the sound source package last inserted is read out and transferred to the instrument 20. In operation, in step Sa-1 as shown in FIGS. 8A and 8B, the instrument 20 checks the slots 25-1 to 25-4 to see whether a new sound source package is inserted into one of the slots or not. If a sound source package is newly inserted into one of slots 25-1 to 25-4, the electronic musical instrument 20 requests the sound source package to transmit the timbre editing program (Sa-2).

This invention may be practiced or embodied in still other ways without departing from the sprit or essential characteristic thereof. For instance, this invention can be applicable to other types of the instruments, such as an electronic wind musical instrument and an electronic stringed musical instrument. In the electronic wind musical instrument, note designation switches and a breath or wind sensor are equivalent to the keyboard 21-1 in the electronic keyboard musical instrument explained above. In the electronic stringed musical instrument, fret switches provided on a fingerboard or a string pitch detection block and strings extended on the fingerboard correspond to the keyboard 21-1.

Additionally, various types and kinds of sound source devices are realized. For instance, a card type or a module type of the packages can be employed. A further different sound generation system is realized in the sound source unit 34 of the sound source package.

The preferred embodiments described herein are therefore illustrative and not restrictive, the scope of the invention being indicated by the appended claims and all variations which come within the meaning of the claims are intended to be embraced therein.

What is claimed is:

1. A sound source package connectable to an electronic musical instrument from outside of the electronic musical instrument, comprising:

sound source means for outputting a sound signal; and timbre editing program storing means for storing a timbre editing program for transfer to said electronic musical instrument so that timbre parameters defining a timbre of a sound signal to be output from said sound source means can be edited by operation of the electronic musical instrument.

2. The sound source package according to claim 1, further comprising processor means for executing a transmission operation of the timbre editing program from said timbre editing program storing means of the sound source package to the electronic musical instrument when the electronic musical instrument is electronically connected to said sound source package.

3. The sound source package according to claim 1, wherein said sound source means comprises means for receiving edited timbre parameters and performance information from the electronic musical instrument when electronically connected to said sound source package, and means for generating a musical tone signal specified by said edited timbre parameters and said performance information.

4. The sound source package according to claim 1, wherein said sound source means includes PCM sound generating circuit means for generating a musical tone signal based on a PCM algorithm, and said timbre editing program storing means stores a timbre editing program for said PCM sound generating circuit means.

5. The sound source package according to claim 1, wherein said sound source means includes non-linear modulation sound generating circuit means for generating a musical tone signal based on a non-linear modulation algorithm, and said timbre editing program storing means stores a timbre editing program for said non-linear modulation sound generating circuit means.

6. The sound source package according to claim 1, wherein said sound source means includes sine wave synthesis sound generating circuit means for generating a musical tone signal based on a sine wave synthesis algorithm, and said timbre editing program storing means stores a timbre editing program for said sine wave synthesis sound generating circuit means.

7. An electronic musical instrument connectable to sound source package means, said sound source package means including sound source means for outputting a sound signal, and timbre editing program storing means for storing a timbre editing program to be read out to the electronic musical instrument, the electronic musical instrument comprising:

timbre parameter editing means for editing timbre parameters defining a timbre of a sound signal to be output from the sound source means of the sound source package means in accordance with said timbre editing program when read out from said timbre editing program storing means; and supplying means coupled to said timbre parameter editing means for supplying said sound source means with edited timbre parameters from said timbre parameter editing means to obtain from said sound source means a sound signal having a timbre defined by said edited timbre parameters.

8. The electronic musical instrument according to claim 7, further comprising at least one connecting means for electronically connecting said sound source package means with said timbre parameter editing means and with said supplying means.

9. The electronic musical instrument according to claim 7, further comprising a plurality of connecting means for electronically connecting a plurality of sound source package means with said timbre parameter editing means and with said supplying means.

10. The electronic musical instrument according to claim 9, further comprising selecting means for selecting a sound source package means among said plurality of sound source package means so that from said selected sound source package means, a timbre parameter editing program is transmitted to said timbre parameter editing means.

11. The electronic musical instrument according to claim 9, further comprising control means for detecting a newly connected sound source package means, and for requesting a detected newly connected sound source package means to send its timbre parameter editing program to said timbre parameter editing means.

12. The electronic musical instrument according to claim 8, further comprising control means responsive to a sound source package means newly connected to said connecting means for automatically requesting said newly connected sound source package means to send its timbre parameter editing program to said timbre parameter editing means.

13. In combination (i) an electronic musical instrument and (ii) a sound source package connectable to said electronic musical instrument from outside of the electronic musical instrument: and said sound source package comprising:

(A) sound source means for outputting a sound signal; and (B) timbre editing program storing means for storing a timbre editing program to be read out to the electronic musical instrument; and said electronic musical instrument including:

(a) timbre parameter editing means for editing timbre parameters defining a timbre of a sound signal to be produced from said sound source means of the sound source package in accordance with said timbre editing program when read out from said timbre editing program storing means; and (b) supplying means coupled to said timbre parameter editing means for supplying said sound source means with edited timbre parameters from said timbre parameter editing means to obtain from said sound source means a sound signal having a timbre defined by said edited timbre parameters.

14. A sound generating device connectable to an electronic musical instrument, comprising:

sound generating means for generating a sound signal; and timbre editing program storing means for storing a timbre editing program for transfer to said electronic musical instrument so that timbre parameters defining a timbre of a sound signal to be generated from said sound generating means can be edited by operation of the electronic musical instrument.

15. An electronic musical instrument connectable to a sound generating device having a sound generation function and storing a timbre control program to be read out to the electronic musical instrument, comprising:

timbre parameter control means for controlling timbre parameters for said sound generating device in accordance with said timbre control program when read out from the sound generating device; and transferring means coupled to said timbre parameter control means and said sound generating device for transferring controlled timbre parameters to said sound generating device to generate a sound signal having a timbre controlled by said controlled timbre parameters.

* * * * *